US008276773B2

(12) United States Patent
Frishman

(10) Patent No.: US 8,276,773 B2
(45) **Date of Patent: *Oct. 2, 2012**

(54) BOTTLE CROWN WITH REMOVABLE FRANGIBLE PORTION

(75) Inventor: Abe Frishman, Carrollton, TX (US)

(73) Assignee: World Bottling Cap, LLC, Carrollton, TX (US)

( * ) Notice: Subject to any disclaimer, the term of this patent is extended or adjusted under 35 U.S.C. 154(b) by 30 days.

This patent is subject to a terminal disclaimer.

(21) Appl. No.: 12/903,533

(22) Filed: Oct. 13, 2010

(65) Prior Publication Data

US 2011/0024381 A1 Feb. 3, 2011

Related U.S. Application Data

(60) Division of application No. 11/698,247, filed on Jan. 24, 2007, now Pat. No. 8,061,544, which is a continuation-in-part of application No. PCT/US2006/002421, filed on Jan. 24, 2006.

(60) Provisional application No. 60/758,725, filed on Jan. 14, 2006.

(51) Int. Cl.
*B65D 41/42* (2006.01)
*B65D 41/34* (2006.01)

(52) U.S. Cl. ..... 215/255; 215/256; 215/328; 220/272; 220/273

(58) Field of Classification Search ..... 215/255, 215/256, 324, 328; 220/272, 273
See application file for complete search history.

(56) References Cited

U.S. PATENT DOCUMENTS

| | | | | | |
|---|---|---|---|---|---|
| 1,294,171 | A | * | 2/1919 | Rockwell et al. | 73/81 |
| 1,516,207 | A | * | 11/1924 | Rockwell | 73/83 |
| 2,046,173 | A | * | 6/1936 | Lenhoff | 215/304 |
| 2,191,447 | A | * | 2/1940 | Beardsley | 215/248 |
| 3,199,705 | A | * | 8/1965 | Brockett | 215/254 |
| 3,206,055 | A | * | 9/1965 | Helbling | 215/303 |
| 3,268,368 | A | * | 8/1966 | Mackiw et al. | 75/246 |
| 3,480,173 | A | * | 11/1969 | Wheaton | 215/251 |
| 3,522,899 | A | * | 8/1970 | Garriques et al. | 215/255 |
| 3,545,638 | A | * | 12/1970 | Brown | 215/255 |
| 3,556,336 | A | * | 1/1971 | Coop | 215/255 |
| 3,598,272 | A | * | 8/1971 | Bustamante et al. | 215/255 |
| 3,630,405 | A | * | 12/1971 | Podesta | 215/254 |
| 3,724,700 | A | * | 4/1973 | Heffran | 215/255 |
| 3,734,333 | A | * | 5/1973 | Foss | 215/255 |
| 3,743,129 | A | * | 7/1973 | Willis et al. | 215/255 |
| 3,823,841 | A | * | 7/1974 | Lovejoy | 215/251 |
| 3,834,573 | A | * | 9/1974 | Amos | 215/255 |
| 3,851,793 | A | * | 12/1974 | Brown | 220/270 |
| 3,870,184 | A | * | 3/1975 | Fuchs et al. | 215/255 |
| 3,905,503 | A | * | 9/1975 | Fraze | 215/255 |
| 3,920,142 | A | * | 11/1975 | Vandrebeck et al. | 215/254 |
| 3,940,254 | A | * | 2/1976 | McMullen et al. | 428/614 |
| 3,958,710 | A | * | 5/1976 | Harding et al. | 215/254 |

(Continued)

*Primary Examiner* — Anthony Stashick
*Assistant Examiner* — Ned A Walker
(74) *Attorney, Agent, or Firm* — Matthew E. Burr

(57) ABSTRACT

A pull tab crown for a bottle or other container provides a pull tab ring and a pull tab secured to the top of the crown by a rivet to form a pull tab assembly. A seat in the top of the crown formed by an indentation allows the pull tab assembly to rest flush with the top of the crown. One or more score lines extend from the pull tab assembly to rim of the crown. One of the score lines has a segment that extends for a distance equidistant from the top of the crown and the edge of the crown. The score lines have a curved cross-sectional profile.

2 Claims, 19 Drawing Sheets

U.S. PATENT DOCUMENTS

| | | | | | |
|---|---|---|---|---|---|
| RE28,862 | E | * | 6/1976 | Siemonsen et al. | 215/255 |
| 3,963,140 | A | * | 6/1976 | Harding | 215/254 |
| 4,060,172 | A | * | 11/1977 | Amabili | 215/295 |
| 4,087,018 | A | * | 5/1978 | Tebbutt | 220/257.2 |
| 4,089,753 | A | * | 5/1978 | McMullen et al. | 205/143 |
| 4,176,014 | A | * | 11/1979 | Ruscoe et al. | 205/143 |
| 4,184,605 | A | * | 1/1980 | Hanson | 220/269 |
| 4,247,374 | A | * | 1/1981 | Ruscoe et al. | 205/143 |
| 4,279,968 | A | * | 7/1981 | Ruscoe et al. | 428/677 |
| 4,318,493 | A | * | 3/1982 | Jacobsen et al. | 220/270 |
| 4,453,644 | A | * | 6/1984 | Berglund | 215/255 |
| RE31,869 | E | * | 4/1985 | Harding | 215/254 |
| 4,534,481 | A | * | 8/1985 | Summers et al. | 215/253 |
| 4,579,761 | A | * | 4/1986 | Ruscoe et al. | 428/542.8 |
| 4,768,667 | A | * | 9/1988 | Magnusson | 215/255 |
| 5,020,686 | A | * | 6/1991 | Dutt | 220/276 |
| 5,069,345 | A | * | 12/1991 | Irwin | 220/270 |
| 5,143,241 | A | * | 9/1992 | Szymanski | 220/270 |
| 5,145,084 | A | * | 9/1992 | Murayama et al. | 220/260 |
| 5,458,253 | A | * | 10/1995 | Shapcott | 215/328 |
| 5,924,739 | A | * | 7/1999 | Garbutt | 283/81 |
| 6,006,933 | A | * | 12/1999 | Henning et al. | 215/328 |
| 6,283,318 | B1 | * | 9/2001 | Lee | 215/254 |
| 8,061,544 | B2 | * | 11/2011 | Frishman | 215/255 |
| 2002/0104852 | A1 | * | 8/2002 | Staniszewski et al. | 222/153.07 |
| 2003/0201266 | A1 | * | 10/2003 | Steffan | 220/258.2 |
| 2005/0279432 | A1 | * | 12/2005 | Takeuchi et al. | 148/603 |
| 2007/0181526 | A1 | * | 8/2007 | Frishman | 215/257 |

* cited by examiner

BOTTLE CROWN WITH REMOVABLE FRANGIBLE PORTION

CROSS-REFERENCE TO RELATED APPLICATIONS

The present disclosure is a divisional of and incorporates by reference and claims priority from the U.S. patent application Ser. No. 11/698,247 filed Jan. 24, 2007 now U.S. Pat. No. 8,061,544, which in turn incorporates by reference and claims priority from provisional patent application Ser. No. 60/758,725, filed in the United States Patent and Trademark Office Jan. 14, 2006, and entitled EASY-PULL BOTTLE CAP, by Abe Frishman; and which is a is a continuation-in-part of co-pending PCT patent application of the same title, Serial No: PCT/US2006/002421 by the same inventor filed Jan. 24, 2006, the disclosure of which is incorporated herein by reference.

FIELD OF THE DISCLOSURE

The present disclosure relates to caps and crowns for beverage bottles and other containers, and in particular, to a manual pull-to-open bottle cap.

BACKGROUND

A beverage bottle that opens manually with relative ease, without the use of a bottle opener, has been a long-felt need for beverage providers. Bottle caps must be tightly secured to the bottle opening to prevent spillage of the contents, loss of pressure (in the case of pressurized or carbonated beverages) and to maintain the hygienic conditions of the contents. The tight seal makes it difficult to open a bottle by hand.

Caps, also referred to interchangeably as crowns, are secured to the bottle opening by crimping the crown down over the open of the container in a series of concave arcs around the circumference of the opening. The arcs create sharp convex points between each concave arc. The arcs and points are often referred to by those skilled in art as "angels."

The advent of the familiar twist-off bottle cap was a significant advance for manual bottle opening, but all too frequently one has to grip the cap so hard to twist the cap free that the points of the cap angels inflict pain on the hands or fingers. To protect the hands from injury, it is a common practice to wrap the bottle cap in the tail of a shirt or in a cloth before twisting the cap.

Bottle caps adapted with pull tabs, similar to those used for beverage cans, have been known in China and other territories of Asia. See, for example, International Patent Application PCT/CN00/00040 by Liu, priority date Mar. 4, 1999, International Publication No. WO00/51906. Such pull tab bottle caps, however, are notoriously difficult to open because they require the exertion of an uncomfortable amount of force to break the seal and then pull the tab back (tearing the metal) to remove the cap.

Another pull-tab solution for bottle caps is known as the MaxiCrown® such as is described U.S. Pat. No. 4,768,667 issued Sep. 6, 1988, to Magnusson. The MaxiCrown® provides a pull ring disposed along the side of the neck of the bottle as an extension of the crown and thus is problematic for use with standard angel-crimping bottle capping machines. Indeed, a special capping machine is recommended to cap bottles with the MaxiCrown°.

There is a need, therefore, for a bottle crown that is easy to open manually yet which may be tightly sealed around the bottle opening using standard bottle capping machines common in the art.

BRIEF DESCRIPTION OF THE DRAWINGS

The detailed description that follows, by way of non-limiting examples of embodiments, makes reference to the noted drawings in which reference numerals represent the same parts throughout the several views of the drawings, and in which.

DETAILED DESCRIPTION

In view of the foregoing, through one or more various aspects, embodiments and/or specific features or sub-components, the present disclosure is thus intended to bring out one or more of the advantages that will be evident from the description. The present disclosure makes reference to one or more specific embodiments by way of illustration and example. It is understood, therefore, that the terminology, examples, drawings and embodiments are illustrative and are not intended to limit the scope of the disclosure. The terms "crown" and "cap" may be used interchangeably in the description that follows.

Figure 1:
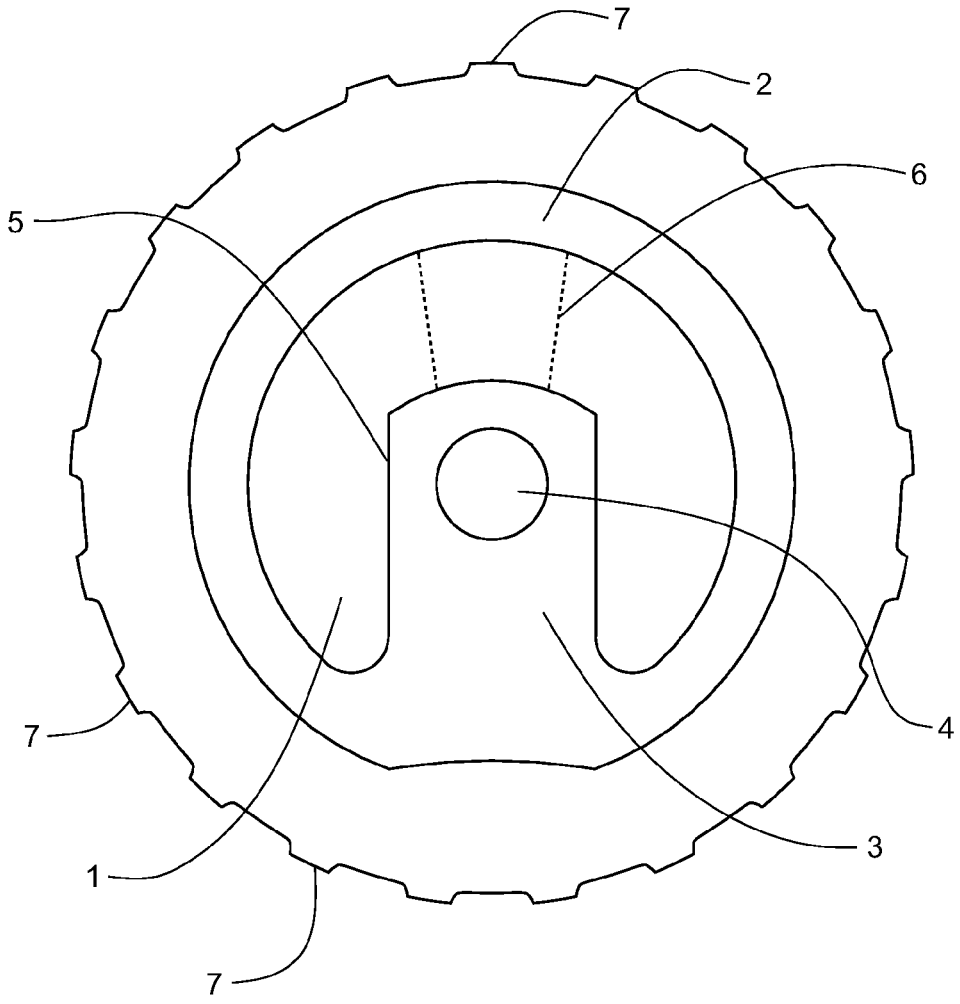
FIG. 1 Prior Art
FIG. 1 is a diagrammatic representation of a top view of a specific exemplary embodiment of a bottle cap of the prior art.

FIG. 1 is a diagrammatic representation of a top view of a specific exemplary embodiment of a bottle cap of the prior art. The lever-type, easy-opening cap shown in FIG. 1 may have crown 1, pull tab ring 2, pull tab 3, rivet 4, and lever 5. Cutting lines 6 may form a horizontal angle of approximately 30 degrees may be provided at the back of the crown cap 1. Significantly, cutting lines 6 do not extend all the way to the rim edge of crown 1, but instead terminate at or near ring 2. A plurality of angels 7 may be formed by crimping cap 1 around a circular bottle opening. Not shown in this view is that, in vertical cross section, cutting lines 6 of the prior art maintain substantially the same depth profile along the length of the cut. A consequence of these various features is that undue manual force may be required to open and remove a crown of FIG. 1 from a container opening.

Crown or cap 1 may be connected to pull tab 3 by lever 5. Lever 5 and pull tab 3 may be joined to make a single unit. Likewise, pull tab 3 and pull tab ring 2 may be a unitary piece. The other end of pull tab 3 may be riveted to the approximate center of the surface on the body of the cap of crown cap 1 by rivet 4.

Figure 2A:
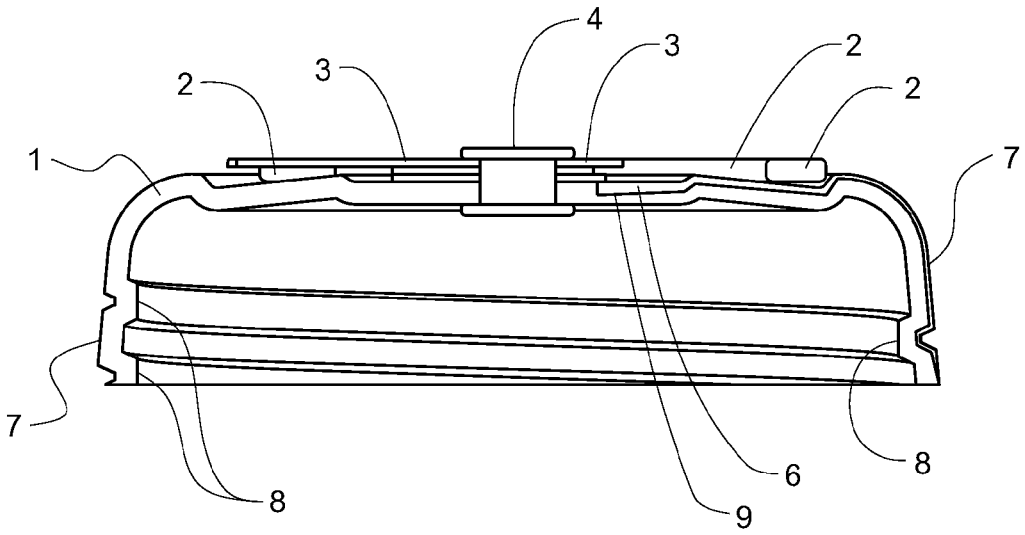
FIG. 2A is a diagrammatic representation of a side view vertical cross-section of a specific exemplary embodiment of a bottle cap of the present disclosure.

FIG. 2A is a diagrammatic representation of a side view vertical cross-section of a specific exemplary embodiment of a bottle cap of the present disclosure. Pull tab ring 2, pull tab 3 and rivet 4 in combination may be referred to herein from time to time as an opener assembly. Interior threads 8 may be provided for selectively removing crown 1 from a bottle by manually twisting instead of using the opener assembly mechanism.

Cutting line 6 tapers downward from angel 7 at the rim of cap 1 toward the approximate center of cap 1 to provide a tapered tearing groove. For example, the depth of the tapered groove may graduate from a depth in the range of approximately 0.03 to 0.02 mm near the rim of cap 1 to a depth in the range of approximately 0.10 to 0.08 mm by rivet 4 near the center of cap 1.

Figure 2B:
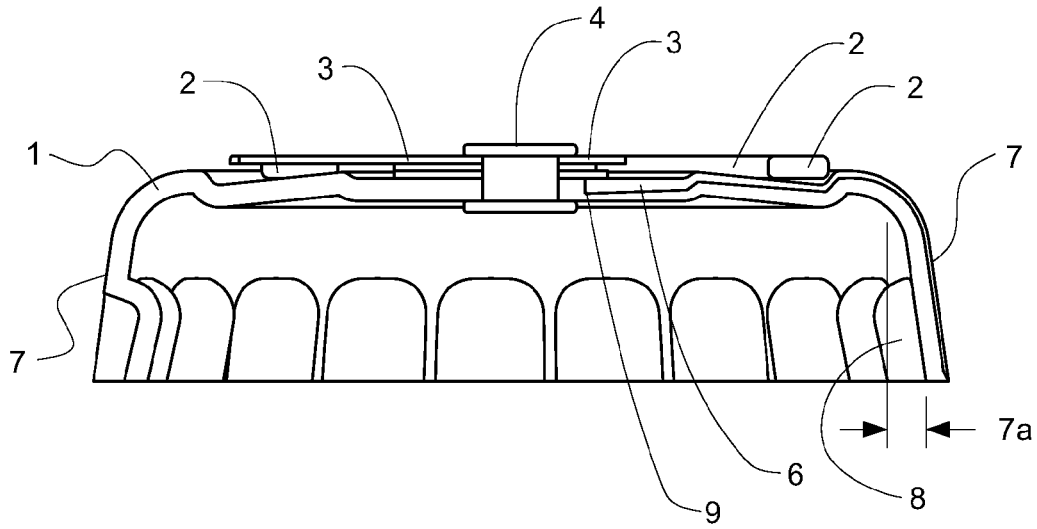
FIG. 2B is a diagrammatic representation of a side view vertical cross-section of an alternative specific exemplary embodiment of the bottle cap of FIG. 2A.

FIG. 2B is a diagrammatic representation of a side view vertical cross-section of an alternative specific exemplary embodiment of the bottle cap of FIG. 2A. The embodiment of FIG. 2B lacks threads 8 and is thus adapted to be opened manually using the opener assembly as described above. Also shown is rim or rim area 7*a*, which may be considered the portion of crown 1 that may be crimped over the opening of a bottle, forming the angels, to secure the crown onto the bottle. Rim 7*a* may be considered to extend from approximately the portion of crown 1 that begins to curve over a bottle opening, or slightly interior to that portion, to the terminus of angel 7.

While terminus 9 of the tearing groove near the center of cap 1 is depicted in FIGS. 2A and 2B as being substantially vertical, it will be understood by those skilled in the art that a selected profile or dimensions of the tearing groove employed in a specific embodiment of a bottle cap of the present disclosure are a question of design and engineering choice, and as such the present disclosure should not be read as limiting in such regards. For instance, the present disclosure contemplates that terminus 9 may be curved, slanted, or otherwise shaped consistent with aims of the present disclosure.

Figure 3A:
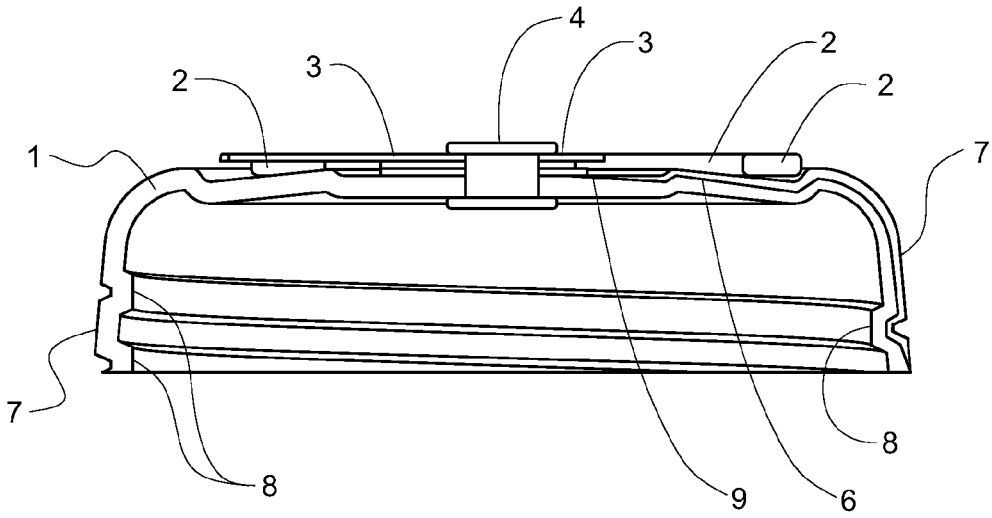
FIG. 3A is a diagrammatic representation of a side view vertical cross-section of an alternative specific exemplary embodiment of a bottle cap of the present disclosure.

FIG. 3A is a diagrammatic representation of a side view vertical cross-section of an alternative specific exemplary embodiment of a bottle cap of the present disclosure. In the embodiment of FIG. 3A, cutting line 6 tapers at terminus 9 as well as toward angel 7 at the rim of cap 1 to provide an alternatively tapered tearing groove in contrast to the embodiment depicted in FIGS. 2A and 2B. By tapering the groove of cutting line 6 such that the thickness of cap 1 increases toward the center and toward the rim, an alternative tearing groove may be provided so that only a reasonable amount of force is called upon to manually tear open cap 1.

Figure 3B:
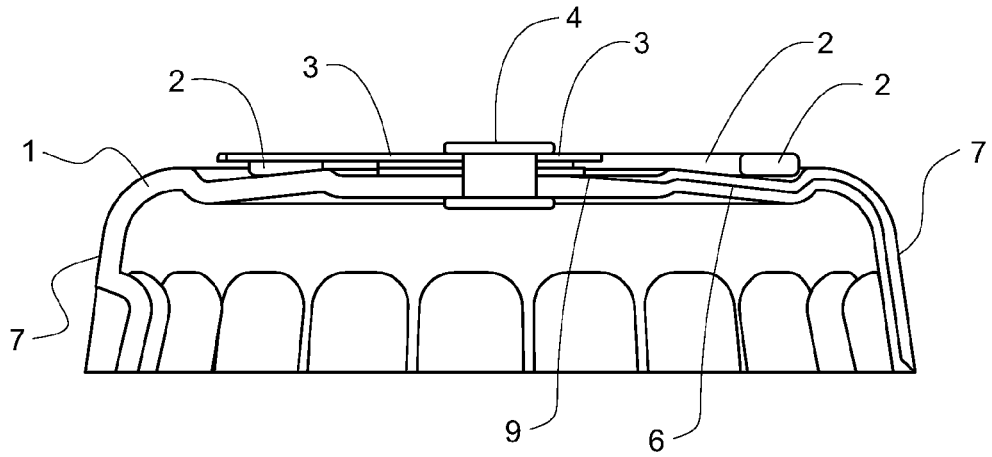
FIG. 3B is a diagrammatic representation of a side view vertical cross-section of an alternative specific exemplary embodiment of the bottle cap of FIG. 3A.

FIG. 3B is a diagrammatic representation of a side view vertical cross-section of an alternative specific exemplary embodiment of the bottle cap of FIG. 3A. The embodiment of FIG. 3B lacks threads 8 and is thus adapted to be opened manually using the opener assembly as described above.

By varying the depth of the groove along cutting line 6, as in either of the embodiments of FIG. 2A, 2B, 3A, or 3B, cap 1 provides a tearing groove which makes it more likely that only a reasonable amount of manual force is called upon to tear open crown 1. As will be discussed in more detail below, a recommended range of dimensions and material composition of crown 1 are disclosed to further provide a crown that may be manually opened with only reasonable force.

In operation, a person grasps ring 2 near tab 3 so as to pivot ring 2 on lever 5 while pulling up and back along cutting line 6. Lever 5 and rivet 4 may act in concert to crack open cap 1 at the center while manual force continues tearing cap 1 along lines 6 until cap 1 is substantially split apart so that cap 1 may be easily removed from a bottle. The tearing groove of cutting line 6 facilitates manually tearing cap 1 along line 6.

Advantageously, the embodiments of FIGS. 2A and 3A may be provided with mating threads 8 along the interior of angels 7 such that crown 1 is adapted to alternatively be opened by twisting or unscrewing crown 1 from a bottle. Also alternatively, cap 1 may be removed using a bottle opener or other means to pop the cap off of the bottle.

Figure 4:
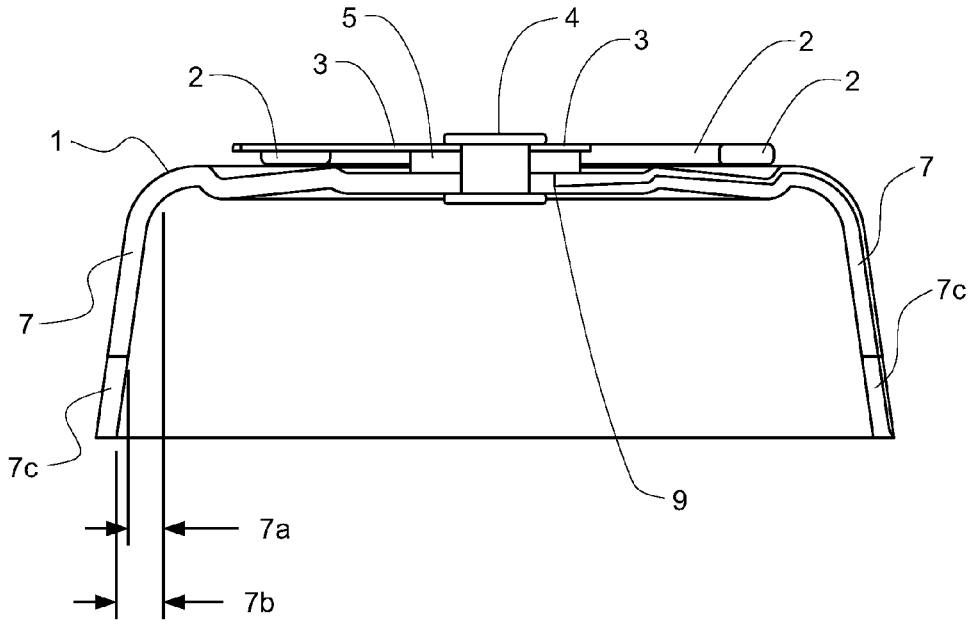
FIG. 4 is a diagrammatic representation of a side view vertical cross-section of an alternative specific exemplary embodiment of a bottle cap of the present disclosure.

FIG. 4 is a diagrammatic representation of a side view vertical cross-section of an alternative specific exemplary embodiment of a bottle cap of the present disclosure. Alternatively or additionally to threads 8, crown 1 may be formed, as shown in FIG. 4, having an elongated rim 7*b* relative to rim 7*a* of FIG. 2. Securing a standard crown over a threaded bottle opening may be problematic because the threads add surface area to the exterior of the bottle opening. A standard crown may not be big enough to extend over the extra surface area of a threaded bottle. Elongated rim 7*b* may be an advantageous alternative embodiment that allows crown 1 to be crimped over a threaded bottle opening to provide elongated angel 7*c*. A further advantage is that a crown of FIG. 4 may be twisted off of a threaded bottle without the crown itself being interiorly threaded such as depicted in FIGS. 2A and 3A.

Lever 5 is provided for leverage and additional shearing force to rend open the tinplate material of crown 1.

Figure 5:
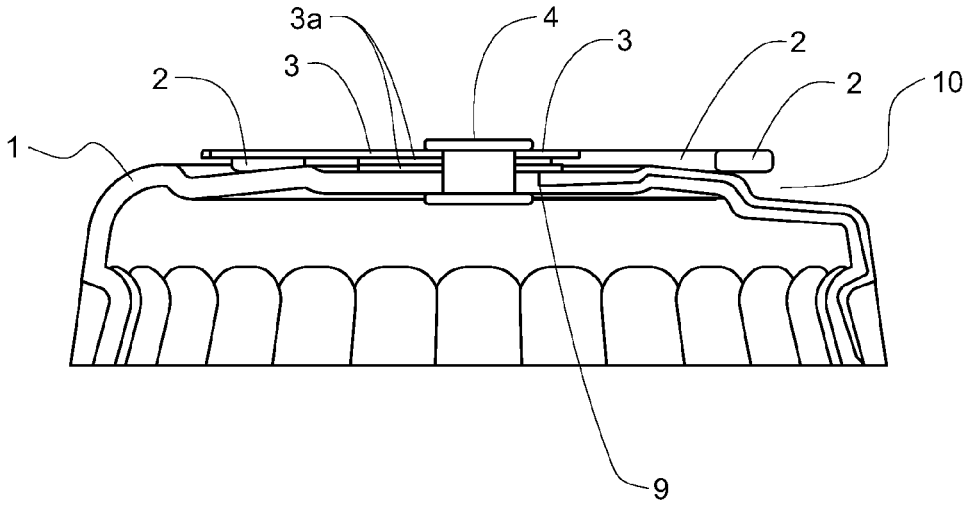
FIG. 5 is a diagrammatic illustration of a side view cross-section of an alternative embodiment of a crown of the present disclosure.

FIG. 5 is a diagrammatic illustration of a side view cross-section of an alternative embodiment of a crown of the present disclosure. In the embodiment of FIG. 5, lever 5 is omitted such that pull tab ring 2 and pull tab 3 are proximate to the top of crown 1. A crown of the present disclosure may provide divot 10 under pull tab ring 2 to facilitate manual grasping of ring 2. That is, divot 10 may provide a void into which a finger tip or a finger nail may fit to exert upward force on ring 2.

Figure 6:
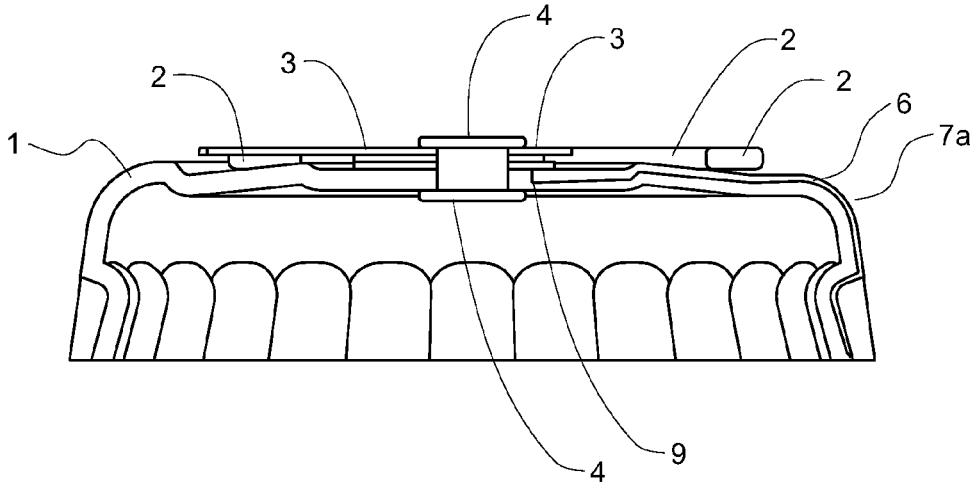
FIG. 6 is a diagrammatic illustration of a side view cross-section of yet another alternative embodiment of a crown of the present disclosure.

FIG. 6 is a diagrammatic illustration of a side view cross-section of yet another alternative embodiment of a crown of the present disclosure. Cut line 6 extends into rim area 7*a* so as to curve downward toward angel 7 to the edge of crown 1.

Figure 7:
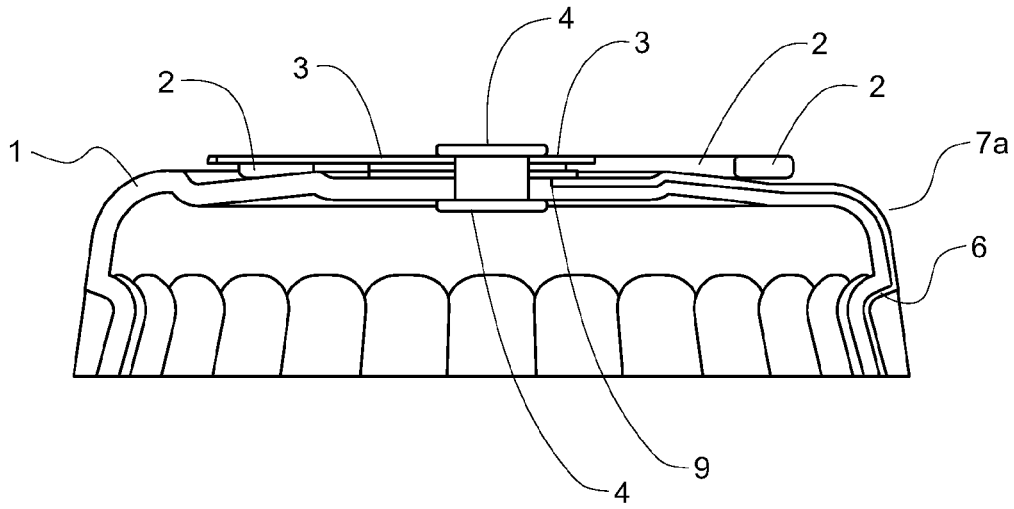
FIG. 7 is a diagrammatic illustration of a side view cross-section of an alternative embodiment of a crown of FIG. 6.

FIG. 7 is a diagrammatic illustration of a side view cross-section of an alternative embodiment of a crown of FIG. 6. Cut line 6 into extends into rim 7*a*, as with FIG. 6, but the depth of cut line 6 is substantially uniform along its length rather than having a variable depth as previously described.

Figure 8:
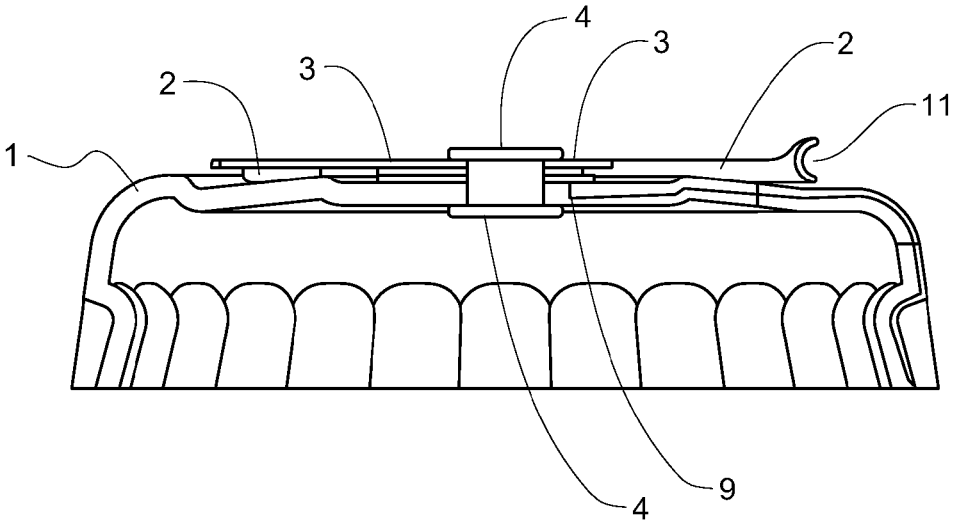
FIG. 8 is a diagrammatic illustration of a side view cross-section of another alternative embodiment of a crown of the present disclosure.

FIG. 8 is a diagrammatic illustration of a side view cross-section of another alternative embodiment of a crown of the present disclosure. Pull tab ring 2 may be provided with one or more arcuate portions 11 to facilitate manual grasping of ring 2 by providing an uplifted space to accommodate a finger tip or finger nail underneath. Arcuate portion 11 is shown for illustration purposes only. The amount or angle of uplift or curvature may be a matter of design choice for a specific embodiment.

Figure 9:
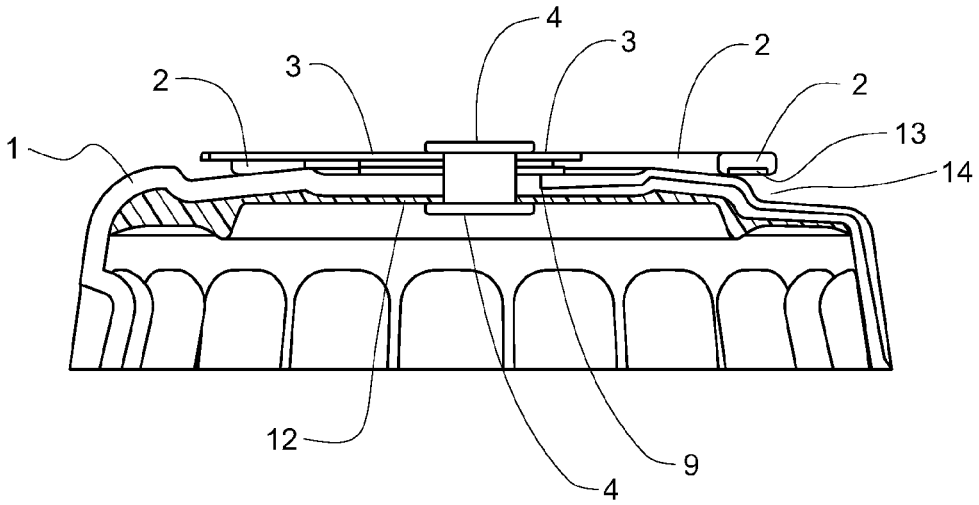
FIG. 9 is a diagrammatic illustration of a side view cross-section of still another alternative embodiment of a crown of the present disclosure.

FIG. 9 is a diagrammatic illustration of a side view cross-section of still another alternative embodiment of a crown of the present disclosure. Liner 12 is secured under crown 1 with rivet 4. Cushion 13 is disposed under pull tab ring 2 to facilitate manual grasping of ring 2 and further to provide tactile comfort by reducing metal-to-skin contact when ring 2 is grasped by a person. Divot 14, similar to divot 10 in FIG. 5, may be an indented portion of crown 1 such that the indentation extends under pull tab ring 2 so that a finger tip or finger nail may be more easily positioned under pull ring 2 to facilitate manual crown removal.

Figure 10:
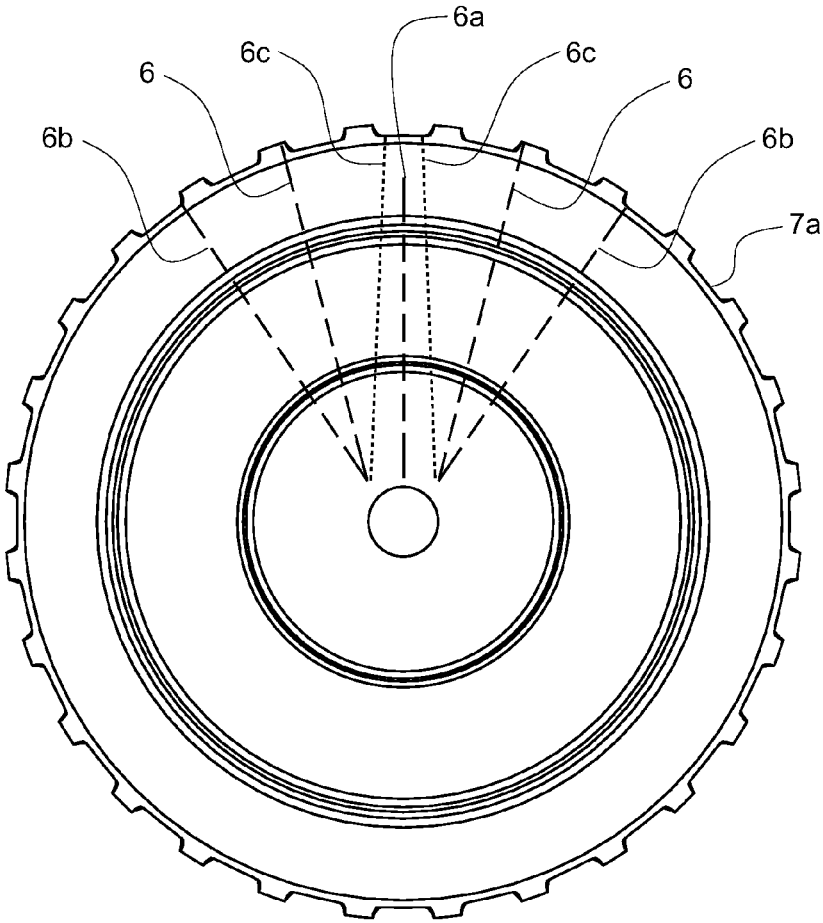
FIG. 10 is a diagrammatic illustration of a top view of a further alternative embodiment of a crown of the present disclosure.

FIG. 10 is a diagrammatic illustration of a top view of a further alternative embodiment of a crown of the present disclosure. Pull tab ring 2, pull tab 3 and rivet 4 are not shown. Cut lines 6 typically diverge toward rim 7*a* from imaginary center line 6*a*. The present disclosure contemplates alternative degrees of divergence 6*b* (dashed lines), for example, or that cut lines 6*c* (dotted lines) may converge toward rim 7*a*. The lines may even be substantially parallel. Convergence or divergence, and the selected degrees or angle separating the lines, is a matter of design choice, as is the number of cut lines, which may be as few as one or even zero. Accordingly, the present invention contemplates all and every permutation of cut lines which may be selected for the engineering design of a particular crown. Additionally, FIG. 10 illustrates an embodiment of the present crown formed to have 28 angels around the circumference of the crown.

Figure 11:
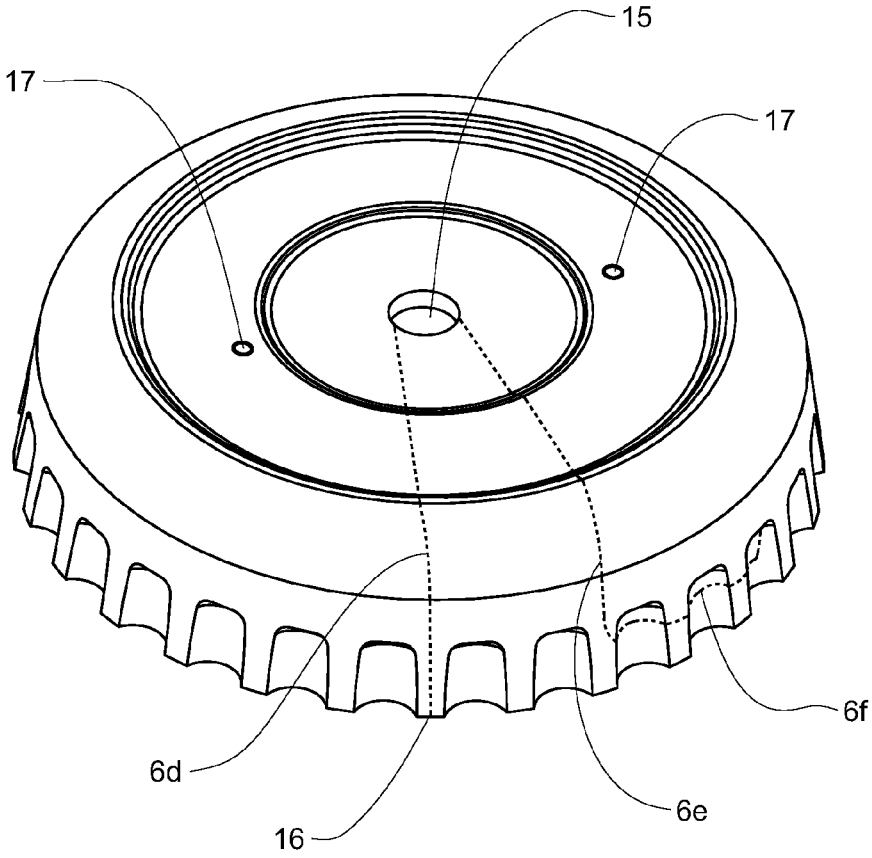
FIG. 11 is a diagrammatic illustration of an isometric top view of an alternative embodiment of a crown of the present disclosure.

FIG. 11 is a diagrammatic illustration of an isometric top view of an alternative embodiment of a crown of the present disclosure. The Easy Pull™ pull tab apparatus is not shown in order to illustrate more plainly the cut lines 6*d* and 6*e*. In a preferred embodiment, one of the cut lines 6*e* provides an S-curve or tail segment 6*f* that extends along the angel portion 7 of crown 1. S-curve 6*f* may facilitate the removal of crown 1 from a container opening. In operation, a person tears from center 15 along cut lines 6*d* and 6*e*. When the tear reaches S-curve 6*f*, the tearing force follows the S-curve away from cut line 6*d* and impels the tear along cut line 6*d* to terminus 16 which breaks open crown 1. Continued tearing force along S-curve 6*f* pulls angel portion 7 away from the container opening (not shown) and releases crown 1 from the container (not shown).

Another feature illustrated in FIG. 11 is one or more spoilage indicators 17 such as dimples depressed in crown 1 and positioned so as not to be obscured by the pull ring apparatus of the present disclosure. For containers that are vacuum sealed, spoilage indicators 17 pop up in the event that the pressure seal is lost.

Figure 12:
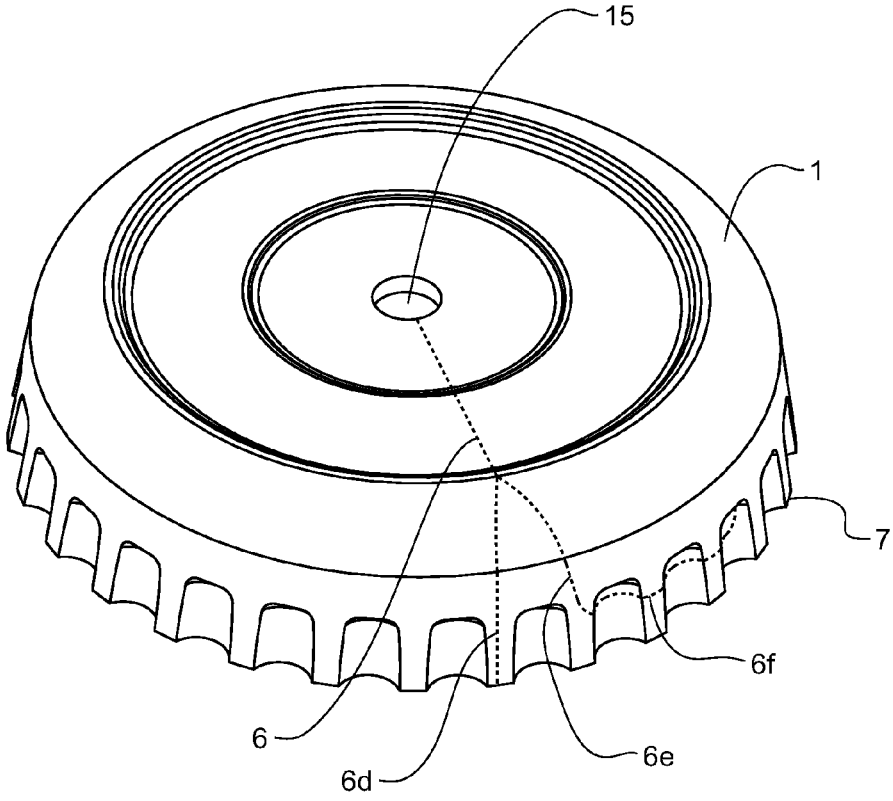
FIG. 12 is a diagrammatic illustration of an isometric top view of an alternative embodiment of a crown of FIG. 11.

FIG. 12 is a diagrammatic illustration of an isometric top view of an alternative embodiment of a crown of FIG. 11. Again, the Easy Pull™ pull tab apparatus is not shown in order to illustrate more plainly the cut lines. The embodiment of FIG. 12 may provide a single cut line 6 extending outward from center 15. Cut line 6 branches or forks in to cut line 6*d* which extends to the edge of crown 1 and cut line 6*e* which curves into S-curve portion 6*f* as described above for FIG. 11.

Figure 13:
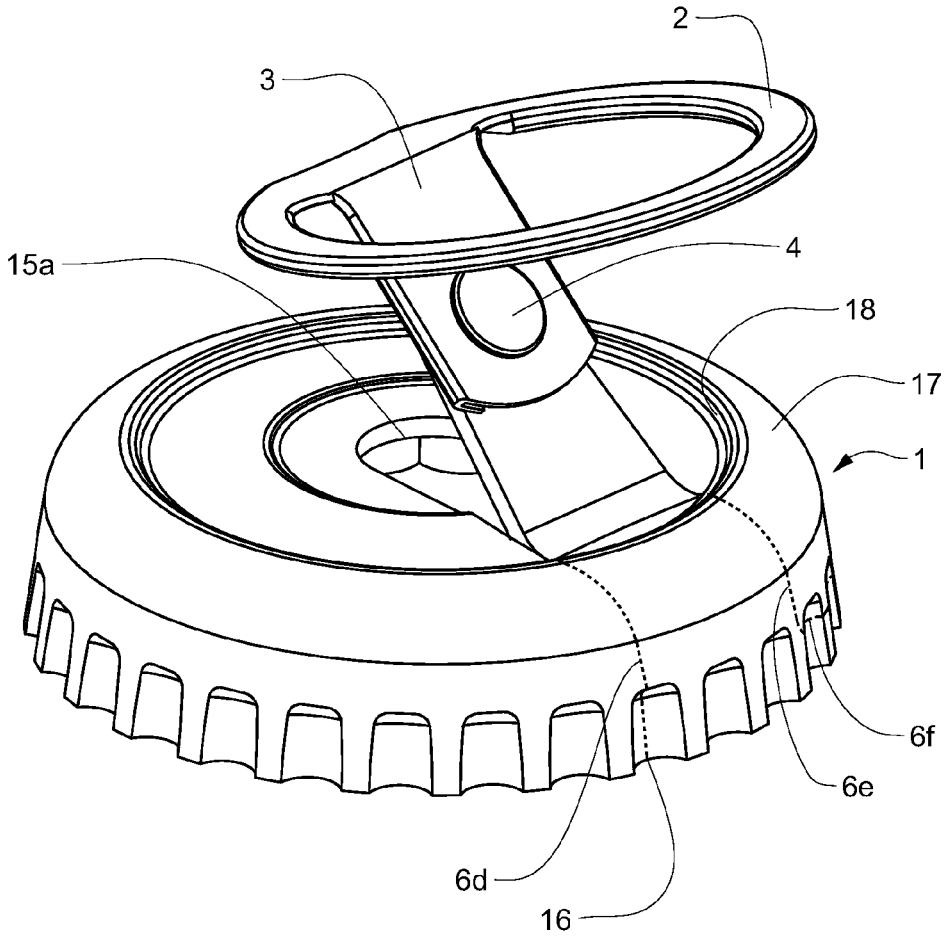
FIG. 13 is a diagrammatic illustration of an isometric top view of an alternative embodiment of a crown of FIG. 11.

FIG. 13 is a diagrammatic illustration of an isometric top view of an alternative embodiment of a crown of FIG. 11. The crown 1 of FIG. 11 is shown popped open in the center 15*a* with pull ring 2. Pull tab 3 is connected to crown 1 with rivet 4 and is in position to tear along cut lines 6*d* and 6*e* with application of manual force. One or more circular depressions 18 create space in the top 17 of crown 1 to seat pull ring 2 and the rest of the opener apparatus.

Figure 14:
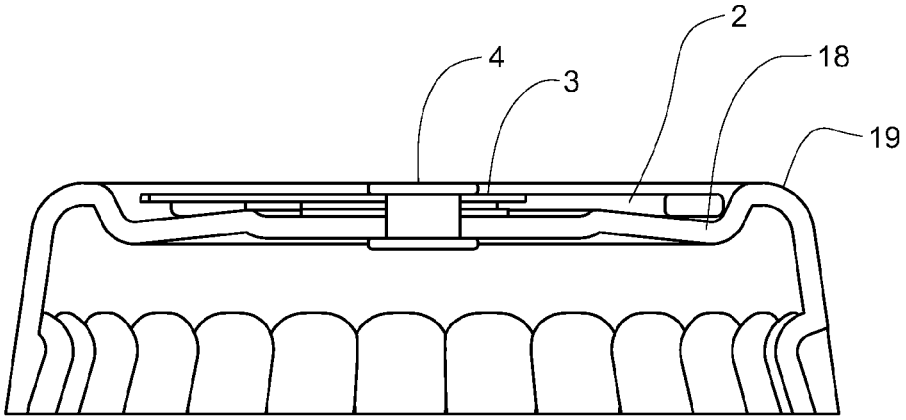
FIG. 14 is a diagrammatic illustration of a side cross sectional view of an alternative embodiment of a crown of FIG. 13.

FIG. 14 is a diagrammatic illustration of a side cross sectional view of an alternative embodiment of a crown of FIG. 13. Seat 18 is of sufficient depth that pull ring 2 is substantially flush with the top 19 of crown 1. Such an embodiment advantageously is suitable for use in conventional bottle capping machines without having to re-tool or -refit the machine. FIG. 14 shows an embodiment of the present crown formed to have 27 angels in circumference around the crown.

Figure 15:
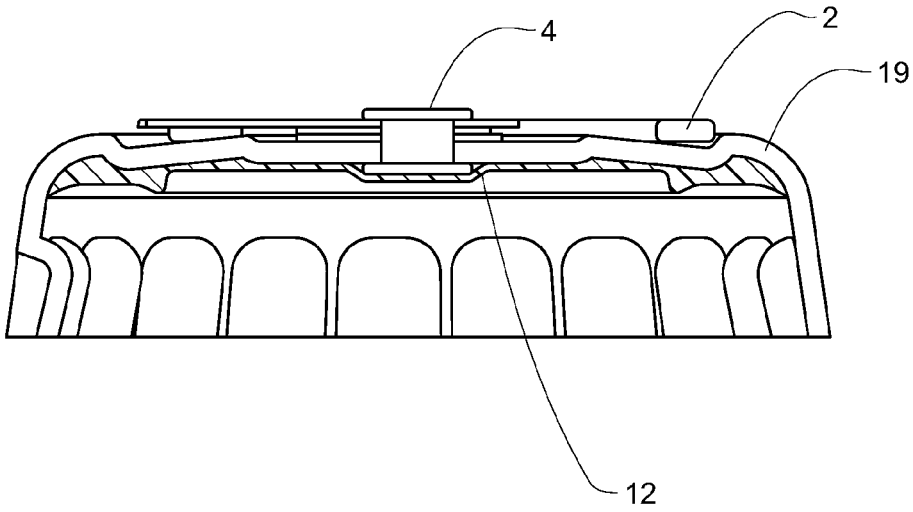
FIG. 15 is a diagrammatic illustration of a side cross sectional view of an alternative embodiment of a crown of FIG. 14.

FIG. 15 is a diagrammatic illustration of a side cross sectional view of an alternative embodiment of a crown of FIG. 14. Seat 13 is shallower than as shown in FIG. 14, so that pull ring 2 is seated slightly or partially above the top 19 of crown 1. Such an embodiment may provide the advantage of having pull ring 2 easily accessible for manual opening. Depending on the acceptable tolerances, such an embodiment may also be suitable for use with a standard bottle capping machine.

FIG. 15 also illustrates an alternative embodiment in which liner 12 is mounted on the under surface of crown 1 with a suitable adhesive and is disposed so as to cover the bottom of rivet 4. Such embodiment may be distinguished from that illustrated in FIG. 9, in which rivet 4 secures liner 12 in position to the underside of crown 1.

Figure 16:
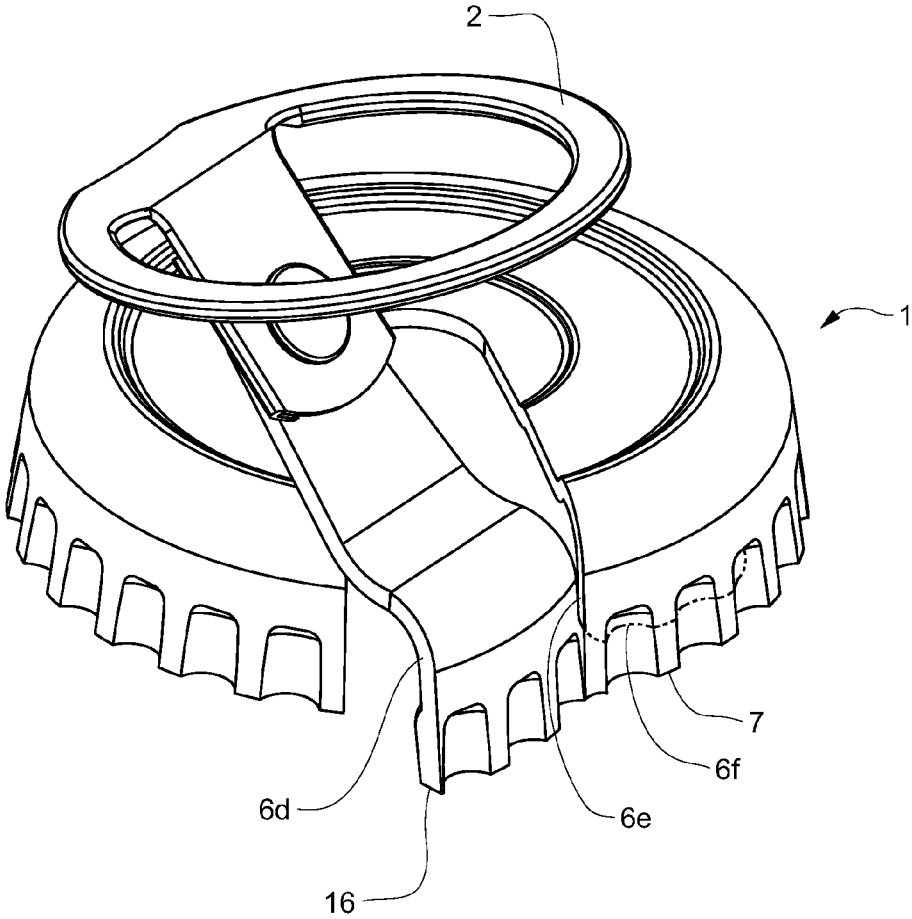
FIG. 16 is a diagrammatic illustration of an isometric top view of an alternative embodiment of a crown of FIG. 13.

FIG. 16 is a diagrammatic illustration of an isometric top view of an alternative embodiment of a crown of FIG. 13. Here, crown 1 is broken open at terminus 16 of cut line 6*d*. Further tearing with pull ring 2 along S-curve 6*f* will liberate a container (not shown) from angels 7 and detach crown 1 from the container.

Figure 17:
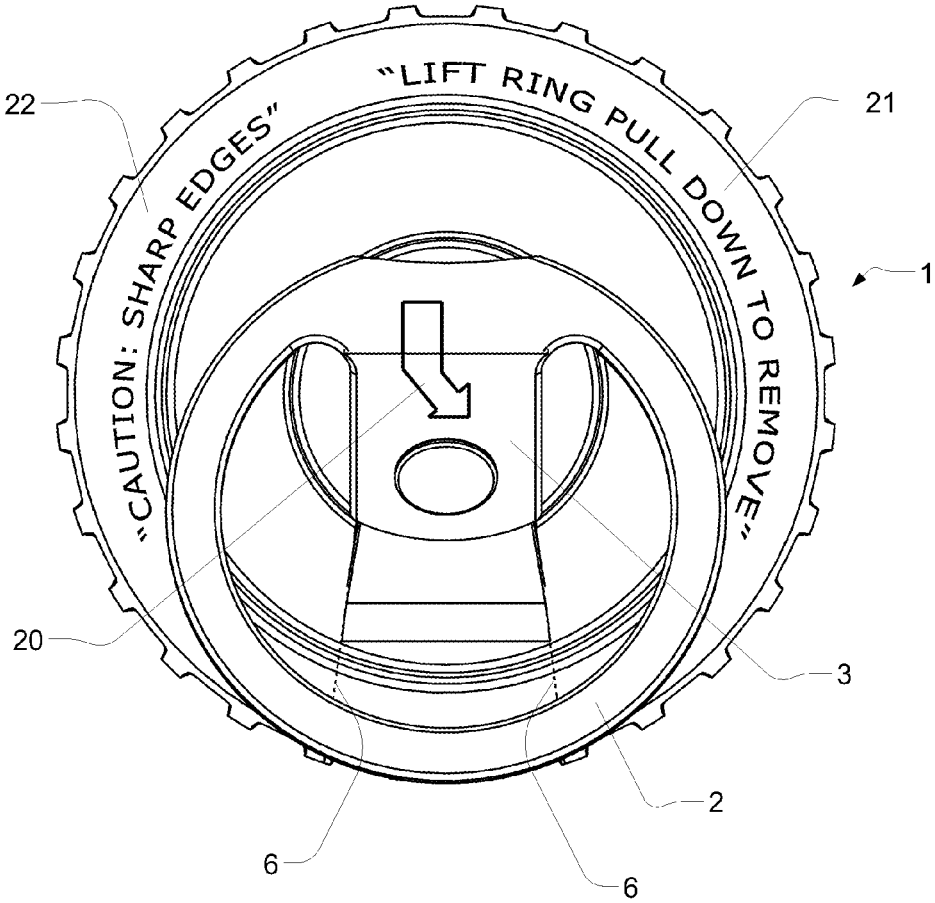
FIG. 17 is a diagrammatic illustration of a top view of an alternative embodiment of a crown of FIG. 13.

FIG. 17 is a diagrammatic illustration of a top view of an alternative embodiment of a crown of FIG. 13. The embodiment of FIG. 17 provides printed matter such as a bent arrow 20 printed on pull tab 3 to indicate generally how a person should pull ring 2 in order to exploit the cut lines 6 for easy opening. Further instructions may be provided with printed instructions 21, which may read, for example: "LIFT RING PULL DOWN TO REMOVE". Additionally a caution warning 22 may be printed on crown 1.

Figure 18A:
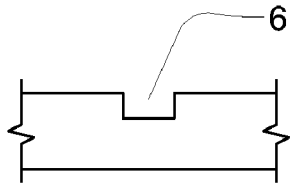
FIG. 18A is a diagrammatic illustration of a side cross section view of an embodiment of a cut line of the present disclosure.

FIG. 18A is a diagrammatic illustration of a side cross section view of an embodiment of a cut line of the present disclosure. To form a tearing groove, cut line 6 may be machined to have any one or more of a variety of cross-sectional profiles, depending on the engineering choice of a particular manufacturer. For instance, FIG. 18A illustrates a square or, rectangular cross section profile.

Figure 18B:
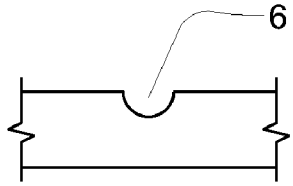
FIG. 18B is a diagrammatic illustration of a side cross section view of an alternative embodiment of a cut line of FIG. 18A.

FIG. 18B is a diagrammatic illustration of a side cross section view of an alternative embodiment of a cut line of FIG. 18A. Here, a curved cross section profile for cut line 16 is illustrated.

Figure 18C:
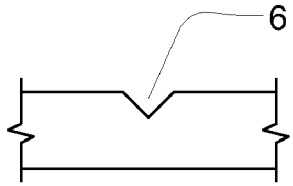
FIG. 18C is a diagrammatic illustration of a side cross section view of an alternative embodiment of a cut line of FIG. 18A.

FIG. 18C is a diagrammatic illustration of a side cross section view of an alternative embodiment of a cut line of FIG. 18A. A V-shaped cross section profile, for cut line 6 is illustrated.

Figure 19:
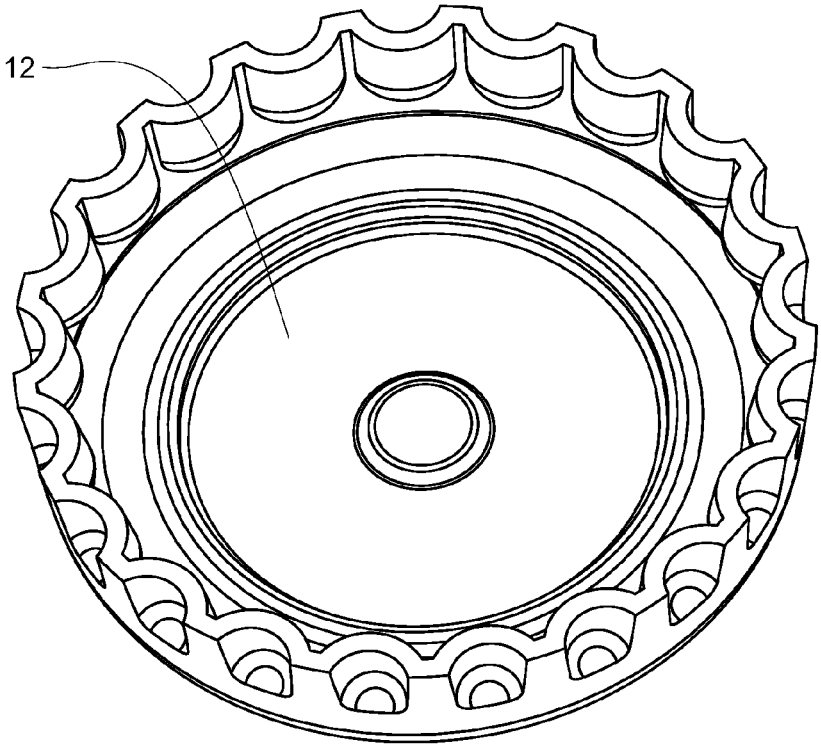
FIG. 19 is a diagrammatic illustration of an isometric view of the bottom of a crown of the present disclosure.

FIG. 19 is a diagrammatic illustration of an isometric view of the bottom of a crown of the present disclosure. Liner 12 adheres to the top of the underside of the crown and is disposed over the bottom of rivet 4. Additionally, FIG. 19 illustrates an embodiment of the present crown formed to have 21 angels in circumference around the edge of the crown.

In addition to the various structures described herein, certain advantages over the prior art are bestowed on the present crown by the recommended specifications shown in Table 1.

TABLE 1

| | Items | Acceptable Range/Target |
|---|---|---|
| 1. | Appearance | Disc properly adhering<br>White liner<br>Complete liner<br>Clean liner<br>Clean crown and ring<br>No rust and scratch for crown and ring<br>Two cut lines on the downward surface of crown<br>Rivet<br>Crown |
| 2. | Dimensions | Thickness (mm): 0.24-0.28<br>Inside diameter (mm): 32.08-32.12<br>Outside diameter (mm): 26.60-26.90<br>Radius of angle (mm): 1.5-1.9<br>Number of angels: 21 |
| | Ring | Diameter (mm): 21.1-21.5<br>Thickness (mm): 0.28-0.32 |
| | Liner | Diameter (mm): 20.00-20.50 |
| 3. | Rockwell Hardness | T4 on the Rockwell 30T scale |
| 4. | Secure Seal | Greater than/equal to 150 PSI for 1 minute |
| 5. | Finish Hardness | Should not scratch with "H" pencil |
| 6. | Sensory | No significant differences with an identified control after 12 weeks at 20 degrees C. |
| 7. | Lubricant Migration | No particles or lubricant should be present |
| 8. | Simulated Palletizing | CO2 loss should not differ against control caps when stored for 1 week with max weight of 45 Kgs over each bottle |
| 9. | Corrosion | Maximum corrosion: slight to moderate |
| 10. | Odor | No off odors detected |
| 11. | Pulling Force of Ring (kg) | 2.5 kg |
| 12. | Composition of Material | Tinplate crown and ring; food class non-PVC for liner |
| 13. | Package | 5000 Crowns per box |
| 14. | Pressure (kg) | 10 kg |
| 15. | Container Loading | 1,000 Master Cartons |
| 16. | Printing | Logo/other design may be printed on the Easy Pull ™ Cap |
| 17. | Crown Anti-Oxidation | Material used is "food grade" PET; clear, with no odor, 1.2 UM (micrometers) |

In particular, a tinplate material which demonstrates an approximate hardness of T-4 on the Rockwell 30T Hardness Scale is preferred for the present cap (see item 3 in table 1). This may be contrasted against the prior art which typically uses tinplate having a hardness of K-3 on the Rockwell scale. The preferred softer tinplate material requires less force to open and tear with the opener assembly of the present crown while still providing sufficient sealing of the container contents. For the purposes of this disclosure, tinplate refers the any material, including tin or tin alloys, from which a crown may be fabricated and does not necessarily mean that the crown is made from tin or a tin alloy.

A pulling force for a pull ring of the present disclosure of approximately 2.5 kg (kilograms) is preferred (see item 11 of Table 1). A relatively small pull force such as this is recommended so that virtually everyone will have sufficient strength to open a bottle using a crown of the present disclosure. In contrast, a relatively large pull force has the disadvantage of requiring a great amount of initial force to tear the tinplate material, and once the tinplate is torn open the sudden release of pulling force causes the bottle to jerk away from the user, spilling the contents often in dramatic fashion.

In addition to the low hardness of the tinplate, the thinness of the crown may also contribute to achieving a small pull force. For example, a crown of the present invention is recommended to have a thickness of less than 0.28 mm (see item 2 in Table 1). Typical bottle crowns have a thickness of 0.28 mm or greater.

The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description. Other embodiments may be utilized and derived therefrom, such that structural, materials, and logical substitutions and changes may be made without departing from the scope of this disclosure. Figures are merely representational and may not be drawn to scale. Certain proportions thereof may be exaggerated, while others may be minimized. Accordingly, the specification and drawings are to be regarded in an illustrative rather than a restrictive sense.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any, and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the claims reflect, inventive subject matter lies in less than all features of a single disclosed embodiment. Thus the following claims are hereby incorporated into the Detailed Description, with each claim standing on its own as a separate embodiment.

The description has made reference to several exemplary embodiments. It is understood, however, that the words that have been used are words of description and illustration, rather than words of limitation. Changes may be made within the purview of the appended claims, as presently stated and as amended, without departing from the scope and spirit of the disclosure in all its aspects. Although description makes reference to particular means, materials and embodiments, the disclosure is not intended to be limited to the particulars disclosed; rather, the disclosure extends to all functionally equivalent technologies, structures, methods and uses such as are within the scope of the appended claims.

I claim:

1. A crown for a container opening, the crown comprising:
- a frangible crown cap body comprising:
  - a closed top having:
    - a recessed seat having a center portion, and
    - an outer shoulder surrounding the recessed seat and extending upward from the recessed seat; and,
  - a skirt extending downward from the outer shoulder, the skirt having:
    - an annular sidewall, and
    - a bottom annular edge;
- an opener assembly comprising:
  - a pull tab ring seated in the recessed seat of the closed top;
  - a pull tab attached to the pull tab ring;
  - a rivet fastening the pull tab to the center portion of the recessed seat; and,
- a frangible scoring arrangement comprising:
  - a score line extending in a continuous radial direction from the center portion of the recessed seat to the bottom annular edge of the skirt; and,
  - a curvilinear score comprising:
    - an upper radial segment extending in a continuous radial direction from the center portion of the recessed seat to the annular sidewall of the skirt, and
    - a lower annular segment extending circumferentially along the annular sidewall of the skirt from the upper radial segment to an endpoint substantially spaced from the bottom annular edge of the skirt.

2. The crown of claim 1, wherein the frangible scoring arrangement defines a frangible portion of the frangible crown cap body, the frangible portion surrounding the rivet and extending outward from the center portion of the recessed seat to the bottom annular edge of the skirt, the frangible portion having a curved profile shape in cross-section.

* * * * *

UNITED STATES PATENT AND TRADEMARK OFFICE

CERTIFICATE OF CORRECTION

PATENT NO. : 8,276,773 B2
APPLICATION NO. : 12/903533
DATED : October 2, 2012
INVENTOR(S) : Abe Frishman It is certified that error appears in the above-identified patent and that said Letters Patent is hereby corrected as shown below:

On the title page, item (60), lines 1-2, "Jan. 24, 2007" should read --Jan. 25, 2007--;

In the specification

Column 1, Line 9, "Jan. 24, 2007" should read --Jan. 25, 2007--.

Signed and Sealed this
Twelfth Day of July, 2016

Michelle K. Lee

Michelle K. Lee
*Director of the United States Patent and Trademark Office*